US010470635B2

(12) United States Patent
Bertrand et al.

(10) Patent No.: US 10,470,635 B2
(45) Date of Patent: Nov. 12, 2019

(54) URBAN OR INDUSTRIAL ASPIRATOR

(71) Applicant: Glutton Cleaning Machines Division de Lange Christian sa, Andenne (BE)

(72) Inventors: Damien Bertrand, Marchin (BE); Christian Lange, Ohey (BE); Franck Buddeker, Flemalle (BE); Jean-Benoît Langouche, Comblain-au-Pont (BE)

(73) Assignee: Glutton Cleaning Machines Division de Lange Christian sa, Andenne (BE)

( * ) Notice: Subject to any disclaimer, the term of this patent is extended or adjusted under 35 U.S.C. 154(b) by 710 days.

(21) Appl. No.: 14/757,715

(22) Filed: Dec. 23, 2015

(65) Prior Publication Data

US 2016/0192815 A1 Jul. 7, 2016
US 2017/0007088 A2 Jan. 12, 2017
US 2018/0049614 A9 Feb. 22, 2018

Related U.S. Application Data

(63) Continuation-in-part of application No. PCT/EP2014/063450, filed on Jun. 25, 2014.

(30) Foreign Application Priority Data

Jun. 25, 2013 (BE) ..... 2013/0445
Aug. 2, 2013 (BE) ..... 2013/0519
Sep. 10, 2013 (BE) ..... 2013/0597

(51) Int. Cl.

*A47L 9/32* (2006.01)
*B25G 1/10* (2006.01)
*A47L 5/36* (2006.01)
*A47L 9/28* (2006.01)
*A47L 5/08* (2006.01)
*A47L 9/04* (2006.01)

(52) U.S. Cl.

CPC ..... *A47L 9/327* (2013.01); *A47L 5/08* (2013.01); *A47L 5/36* (2013.01); *A47L 9/0483* (2013.01); *A47L 9/2857* (2013.01); *B25G 1/102* (2013.01)

(58) Field of Classification Search

CPC ..... A47L 9/327; A47L 5/08; A47L 9/0483; A47L 9/2857; A47L 5/36; A47L 9/32; B25G 1/102
USPC ..... 15/327.1, 344, 410
See application file for complete search history.

(56) References Cited

U.S. PATENT DOCUMENTS 4,179,805 A 12/1979 Yamada
5,529,357 A 6/1996 Hoffman
5,722,110 A 3/1998 McIntyre et al.
8,108,966 B1 2/2012 Viviano
(Continued)

FOREIGN PATENT DOCUMENTS

DE 20 2004 020 278 U1 5/2005
DE 20 2009 001 354 U1 4/2009
FR 2 393 657 A1 1/1979

*Primary Examiner* — David Redding
(74) *Attorney, Agent, or Firm* — Reinhart Boerner Van Deuren P.C.

(57) ABSTRACT

The present invention relates to a device in the form of a suction nozzle (10) for an urban or industrial aspirator (1), preferably self-propelled, comprising a rigid hose or tube (1000), said rigid hose or tube comprising gripping means (100, 200, 300, 400) that comprise a first gripping element (110, 210, 310, 410) in the form of a handle, a support element (120, 220, 320, 420) serving as a lever, and a second gripping element (130, 230, 330, 430) and optionally a base (101, 201, 301, 401).

36 Claims, 15 Drawing Sheets

(56) References Cited

U.S. PATENT DOCUMENTS

| | | | |
|---|---|---|---|
| 8,230,551 | B2 | 7/2012 | Borgerink et al. |
| 2008/0030032 | A1 | 2/2008 | Gill |

URBAN OR INDUSTRIAL ASPIRATOR

CROSS-REFERENCE TO RELATED PATENT APPLICATIONS

This patent application is a continuation-in-part of PCT/EP2014/063450, filed Jun. 25, 2014, which claims the benefit of Belgium Application No. 2013/0445, filed Jun. 25, 2013, and Belgium Application No. 2013/0519, filed Aug. 2, 2013, and Belgium Application No. 2013/0597, filed Sep. 10, 2013, the entire teachings and disclosures of which are incorporated herein by reference thereto.

SUBJECT-MATTER OF THE INVENTION

The present invention relates to devices (preferably self-propelled) with a thermal or electric motor that allow the aspiration of all types of urban or industrial waste, typically called urban or industrial aspirators.

More particularly, the present invention relates to a device performing the function and more generally assuming the form of a suction nozzle, and still more particularly means for gripping said suction nozzle of such an urban or industrial aspirator.

The present invention also relates to an accessory used as assistance or support for maintaining a portable device or object such as a suction nozzle.

TECHNOLOGICAL BACKGROUND AND PROBLEMS TO BE RESOLVED

Self-propelled devices that serve as urban or industrial aspirators have existed for several decades.

They are essentially used by sanitation agents to clean urban, industrial and/or recreational sites. Major improvements have been made to this type of device.

In particular, thermal motors have been replaced by electric motors that may or may not be associated with batteries, which are quieter and also make it possible to separate the pulling functions from the suction functions. These devices have an autonomy ranging from several hours to several days.

Currently, this type of device is equipped with a suction hose or suction nozzle that is manipulated by the sanitation agent and the distal end of which comes into contact with the zones to be cleaned or suctioned and in particular the ground, which allows direct aspiration of waste so that it can be brought to a suitable container placed on the (self-) propelled device.

The useful aspiration must be relatively high to be able to be capable of suctioning all types of waste, including large waste (high volume and/or weight). As an example, the aspiration may reach a pressure corresponding to a value of 500 mm of water column for an air flow rate of 2700 $m^3$ per hour and with a speed of the air in the nozzle that may reach 36 meters per second.

The nozzles must be wide enough and have a minimum diameter of 60 km, but in some cases may also reach values greater than 160 mm.

The suction nozzles can be made in the simplest versions using a PVC tube, or in the new, more sophisticated versions with a carbon tube having a maximum thickness of approximately 0.8 mm to 1.5 mm. Providing a carbon tube therefore makes it possible to lighten the weight of the nozzle while maintaining the appropriate strength characteristics of the nozzle.

However, it has been observed that the manipulation by a sanitation agent is typically done using one arm, which requires a certain amount of dexterity and, over time, will create fatigue, discomfort, and in some cases even pain that may cause the sanitation agent to stop working temporarily. Furthermore, it should be noted that such machines are used over relatively long periods of time that may reach several hours.

Thus, it has been observed that pain may appear primarily in the shoulder, elbow and wrist during long-term use.

It has already been proposed to adapt the handle for maintaining said nozzle and to present it in the form of a "crutch" handle provided with an armrest that can be adjustable in all three rotation axes, thus allowing manipulation of the nozzle, according to the anchoring point, directly on the nozzle or depending on the height of the armrest of the crutch handle.

Lastly, it is also possible to consider adapting the various gripping means as a function of the morphology of the sanitation agent. However, during movement or during the working suction phase, the nozzle is currently positioned such that the arm and the shoulder are in the pulling position. Yet this pulling position is an unnatural tension position that should be avoided as much as possible. Furthermore, this tension position can generate a "break" in the position of the wrist (wrist bent and not positioned in the extension of the forearm). Lastly, it has been observed, even when the gripping means are adapted to the morphology of the user, that there is an offset of the load application axis. In summary, one can say that this position becomes uncomfortable or even painful, in particular for long working periods.

It has also been noted that the contact between the distal end of the nozzle and the ground, or the walls to be suctioned, can generate a small impact that will have repercussions in the wrist, forearm, elbow and shoulder. Over time, this can also lead to a certain bother for the user (i.e., the sanitation agent) during relatively long assignments.

It has been proposed to reduce the effects of this impact during contact between the nozzle and the ground by modifying and adapting the distal end of the nozzle, for example by proposing the placement of a shoe formatted and made from a material having a damping function, such as rubber or an elastic plastic. This shoe is also intended to reduce the wear of the distal end of the nozzle, in particular during repeated contact between the distal end of the suction nozzle and the ground, or the wall to be suctioned.

Nevertheless, because the presence of such a shoe allows complete contact between the section of the nozzle and the ground or wall to be suctioned, the vacuums are relatively high, which requires a significant effort from the sanitation agent to move or lift said nozzle. Furthermore, this effort is typically exerted using a single upper limb (user's arm).

Lastly, it has been observed that the hose that connects the suction nozzle to the urban or industrial aspirator is essentially positioned in the upper part of the chassis of the urban or industrial aspirator, which will also create a load directly passed on to the user's arm.

The present invention aims to propose a solution that makes it possible to resolve these various problems by adapting the general structure of the urban or industrial aspirator, and more particularly the gripping means of the suction nozzle.

BRIEF DESCRIPTION OF THE INVENTION

The present invention relates to a "portable" device acting as a suction nozzle for an urban or industrial aspirator, preferably self-propelled, essentially assuming the form of a rigid hose or tube with a diameter preferably comprised between 60 and 180 mm, said rigid hose or tube comprising gripping means that comprise a first gripping element in the form of a handle, a support element serving as a lever, and a second gripping element and optionally a base.

Preferably, the length of the first gripping element is greater than 200 mm.

Preferably, the height of the first gripping element is less than 100 mm.

Preferably, the first gripping element has both its distal and proximal ends directly or indirectly connected to the rigid hose or tube of the nozzle, and preferably by the base.

Preferably, the gripping means are secured to a sliding rail on which they can move and which is preferably positioned longitudinally and parallel to the central axis on the outer periphery of the rigid hose or tube of the suction nozzle, thus allowing the adjustment and accurate positioning of the gripping means on said rigid hose or tube.

Preferably, in the device according to the invention, the first gripping element in the form of a handle is positioned longitudinally on the hose or tube of the suction nozzle.

Preferably, the first gripping element is positioned parallel to the central axis or one of the generatrices of the hose or tube of the nozzle.

Alternatively, the first gripping element can be positioned with an angle comprised between 5° and 60°, and preferably between 10° and 45° and even preferably between 25° and 45° relative to the central axis or one of the generatrices of the hose or tube of the nozzle.

Advantageously, the second gripping element is positioned at the end of the first gripping element toward the distal end of said nozzle, while the support element serving as a lever is positioned toward the proximal end of said nozzle at the other end of the first gripping element.

Preferably, the support element is positioned with an angle comprised between 95° and 145° relative to the first gripping element in handle form.

Preferably, the support element has an outwardly curved shape for example with a convex shape, and more particularly has an angle on its distal part between the support element and the first gripping element greater than 120°.

Preferably, the support element has, from its base, a height of at least 200 mm, preferably at least 250 mm, but preferably less than 350 mm.

Advantageously, the gripping means, and more particularly the first gripping element, are equipped with a control switch for the suction turbine.

Particularly selection means are also provided in order to organize the selection of the material in the corresponding direction according to its nature.

Particularly advantageously, the command of the suction turbine is done wirelessly or by radio frequency (RF).

Preferably, the gripping means are symmetrical so as to allow ambidextrous use.

Preferably, the gripping means further comprise a third gripping element used to reinforce the structure, preferably by connecting the support element to the nozzle and preferably to the base of the gripping means.

According to another aspect of the invention, the distal end of the suction nozzle is equipped with a shoe made from a rigid or non-rigid material (for example having damping functions).

Advantageously, the distal end of the shoe has a particular design (or means) allowing the air intake through preferably lateral orifices.

Advantageously, the means allowing the introduction of air through the orifices are made up of or comprise sweeping elements such as fringe or bristles.

According to another aspect of the invention, said nozzle also comprises additional maintaining and support means.

Preferably, the maintaining or support means are made up of a strap, shoulder strap or harness.

Preferably, the maintaining or support means comprise coupling/uncoupling means that allow fast and easy coupling/uncoupling.

Preferably, the coupling/uncoupling means assume the form of a magnet-counter-magnet/metal plate.

Preferably, the coupling/uncoupling means are placed on either side of the device so as to make its manipulation ambidextrous.

The present invention also relates to a device called an urban or industrial aspirator, preferably self-propelled or in which the user is seated, and comprising the suction nozzle as described above.

Preferably, the fastening of the flexible hose that connects the suction nozzle to the device is done at the lower half of said device.

Another object of the present invention relates to a portable device characterized in that it is provided with maintaining or support means, such as a strap, shoulder strap or harness, that comprise coupling/uncoupling means that allow fast and easy coupling/uncoupling.

Preferably, the coupling/uncoupling means of maintaining or support means, such as the strap, shoulder strap or harness to the portable device, comprise a magnet and counter-magnet, for example a single metal plate; said magnet preferably being positioned on the portable device, the counter-magnet being positioned on the maintaining and support means or vice versa.

DETAILED DESCRIPTION OF THE INVENTION

The present invention will be described in more detail in one or more preferred embodiments of the invention in reference to the appended figures and for which elements or details can be combined or omitted. The same is true regarding a combination of details used in the figures that represent the state of the art with the essential elements of the present invention.

Figure 1A:
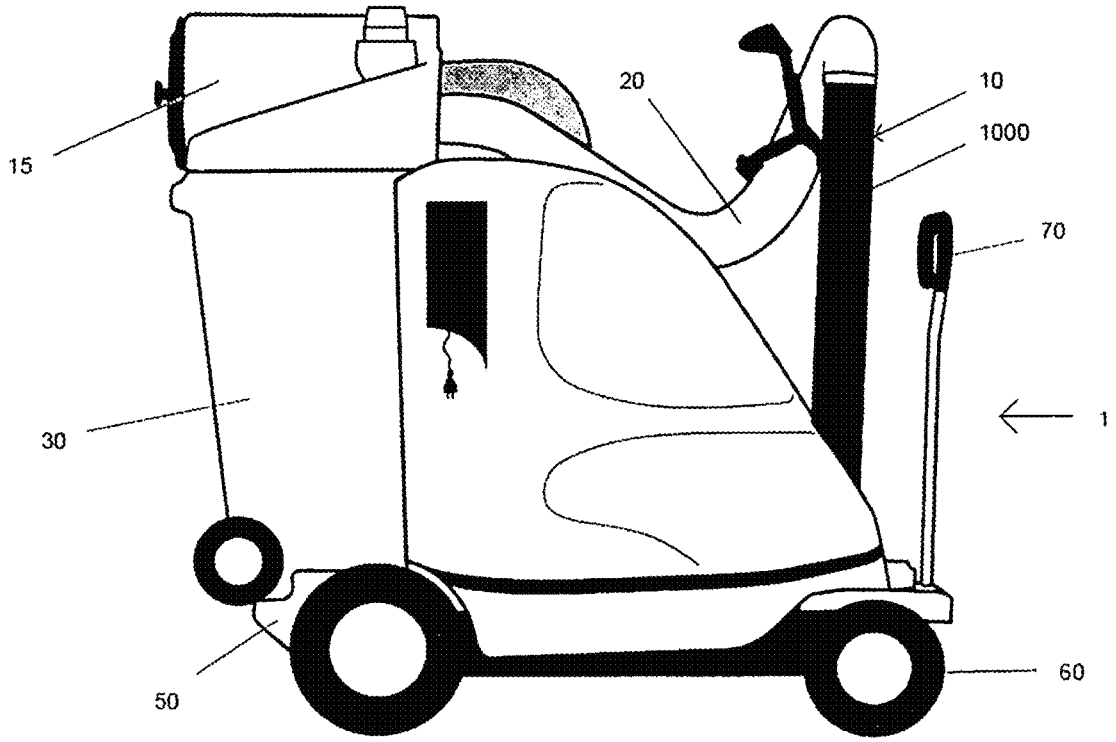
FIG. 1*a* shows a device serving as an urban or industrial aspirator as currently used according to the state of the art, but also able to be used according to the present invention.

FIG. 1*a* shows a general view of an urban or industrial aspirator that is simply diagrammed by reference 1 and is provided with a device acting as a suction nozzle 10. This suction nozzle 10 generally assumes the form of the rigid hose or tube 1000 having a length comprised between 1.20 m and 1.50 m so as to be able to be in contact at its distal end 2 with the ground or the walls to be suctioned, its proximal end 3 being connected to a flexible hose 20, essentially with the same diameter as that of the nozzle 10, and having a length comprised between 2 m and 3 m, preferably close to 2.50 m. According to certain configurations, it is possible to consider the presence of a flexible hose 20 that is much longer, for example having a length from 5 m to 6 m, or even more than 10 m. Indeed, it is possible to consider directly cleaning surfaces such as railroad track rails with a very long flexible hose (more than 15-20 m), the urban or industrial aspirator for example remaining on the train station platform. The proximal end of said flexible hose 20 will advantageously be directly connected to the urban or industrial aspirator 1. The distal end is connected to the rigid hose or tube 1000 of the nozzle 10.

Figure 1B:
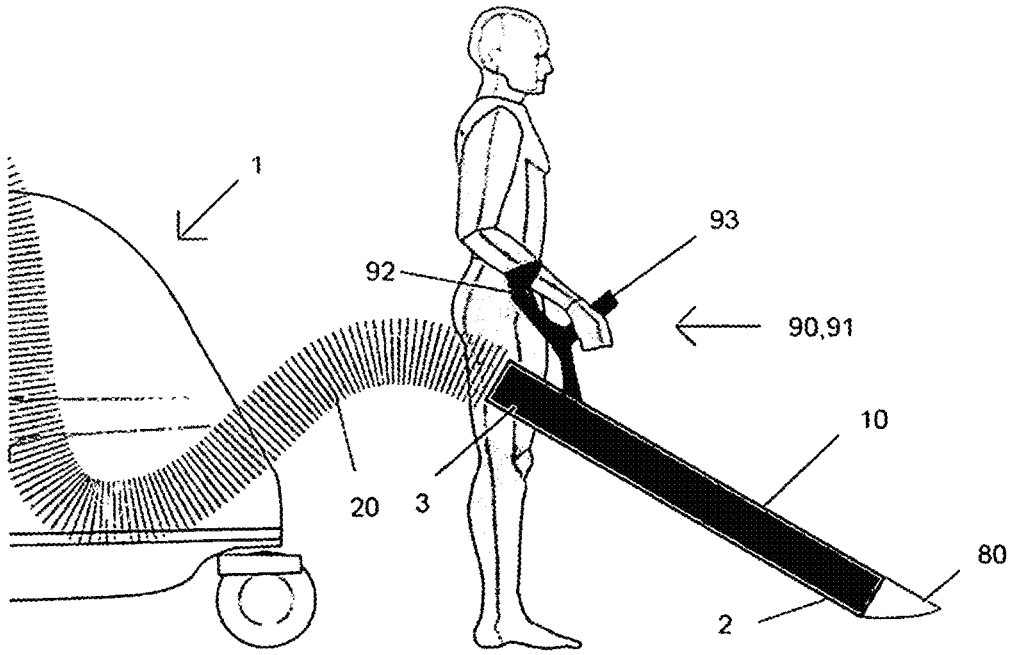
FIG. 1*b* shows a more detailed view of a suction nozzle connected to the urban or industrial aspirator as described in FIG. 1*a*.

This suction nozzle 10, which constitutes a portable device, is taken directly in hand by the sanitation agent, as shown in FIG. 1*b*.

The combined dimensions of the flexible hose 20 and the suction nozzle 10 allow the sanitation agent to have an action radius of at least 3 m around said machine 1 over all of the rotation axes (360°). The dimension of the nozzle is appropriately calculated so as to be able to be manipulated by any sanitation agent (man, woman, tall or short stature).

The suction nozzle 10 essentially comprises a rigid hose or tube 1000 made from a material that can be PVC, carbon or any other equivalent rigid material. This hose or tube 1000 must be solid and strong enough, but also as light as possible.

Advantageously, the weight of said nozzle will be less than 2 kg, and preferably less than 1.5 kg.

Motors (not shown) allow the suction and mobility of the aspirator 1. The motors can be made either by one or more thermal motors, or one or more electric motors.

Particularly advantageously, electric motors are currently favored due to their low noise annoyance. More particularly, and still more advantageously, it is possible to consider the presence of two electric motors, one being directly dedicated to the mobility of the aspirator, the other being dedicated to the suction power. Of course, when electric motors are used, it is necessary to provide batteries that allow a relatively short recharge time with an autonomy of several hours, and if possible 6 to 8 hours.

Likewise, a container 30 collecting the waste, and a filter 15, are positioned on the chassis 50 provided with locomotive means 60. Lastly, a handlebar 70, in the form of a simple controller, makes it possible to control the forward or backward motion of the urban or industrial aspirator and its rotation. The chassis 50 is traditionally a mechanically welded chassis, optionally made from steel or stainless steel. A chassis made from aluminum may also be considered.

According to another configuration that is not shown, it is possible to consider that the chassis can also carry the user. In this scenario, it no longer involves a self-propelled device, but a device driven by the user. However, this device will also be provided with a suction nozzle, optionally longer, and as described here, i.e., with the essential features of said invention.

Figure 1C:
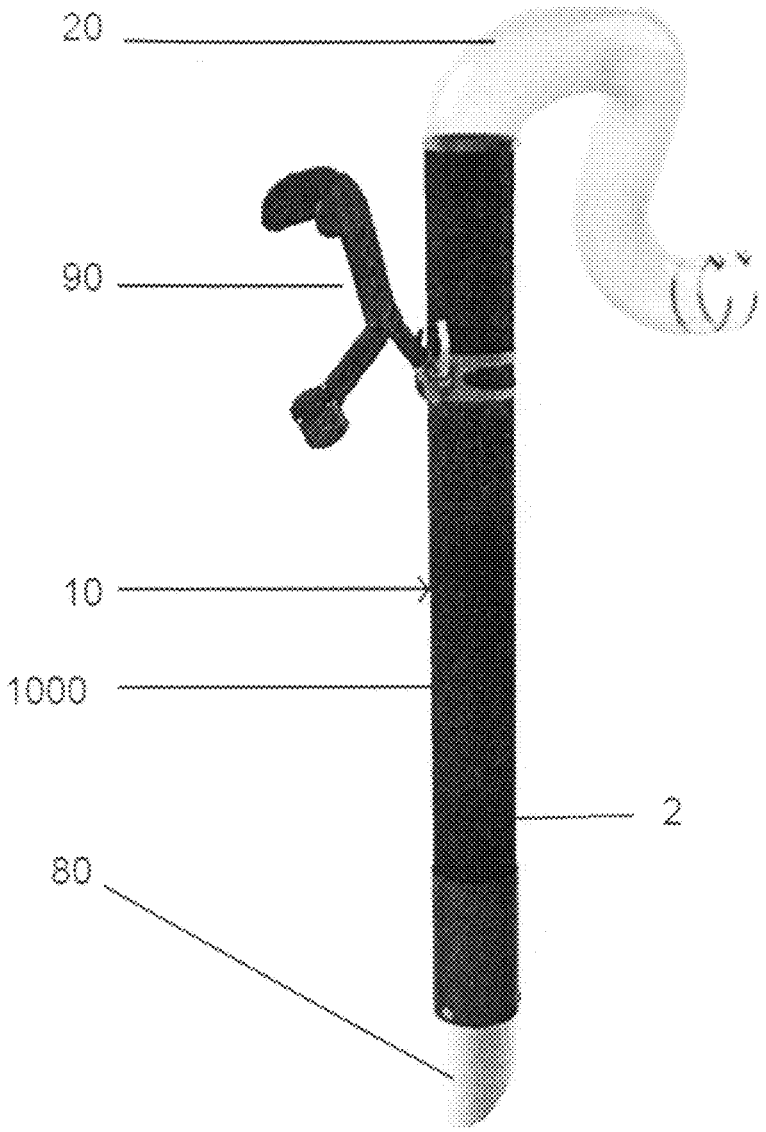
FIG. 1*c* shows a suction nozzle and its gripping means as used according to the state of the art.

Advantageously and as shown in FIG. 1*c*, the rigid hose or tube 1000 of the nozzle 10 is provided at its distal end 2 with a shoe 80 that makes it possible on the one hand to protect said hose or tube 1000 against wear or erosion, and on the other hand to damp impacts each time the hose or tube 1000 comes into contact with the ground or walls to be suctioned, preferably made from a shock absorbing material (elastic plastic).

According to the state of the art, and as shown in FIG. 1*c*, the gripping means 90 are made from an element assuming the form of a crutch handle 91 provided with an armrest 92 and a gripping handle 93. This handle 93 is positioned perpendicular to the armrest 92. This armrest is used to correctly position the elbow while avoiding any lateral movement. The gripping handle is positioned at a relatively large height generally exceeding 150 mm from the hose or tube of the nozzle, which will require the user to bend his arm when he moves said suction nozzle and to position his arm in the pulling position.

Figure 1D:
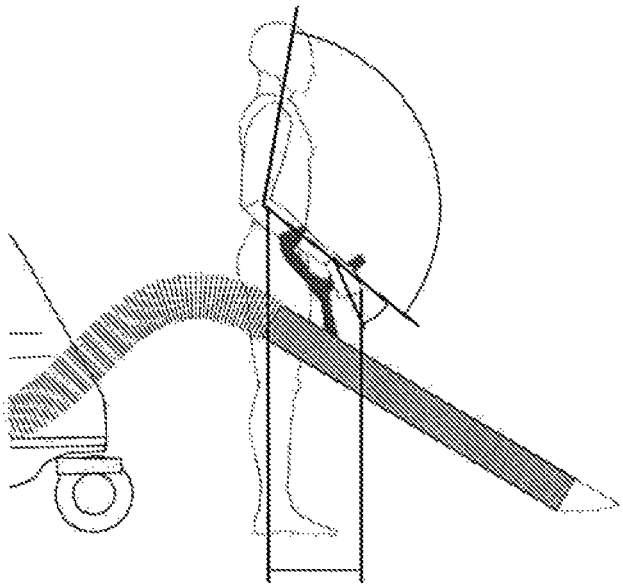
FIG. 1*d* diagrammatically shows the positioning of a user using a suction nozzle with its gripping means as described in FIG. 1*c*.

As already described in detail in the chapter dedicated to the state of the art and shown directly in FIG. 1*d*, one can see that this type of gripping means includes a certain number of drawbacks essentially due to the non-ergonomic position of the user while he is working.

Figure 2A:
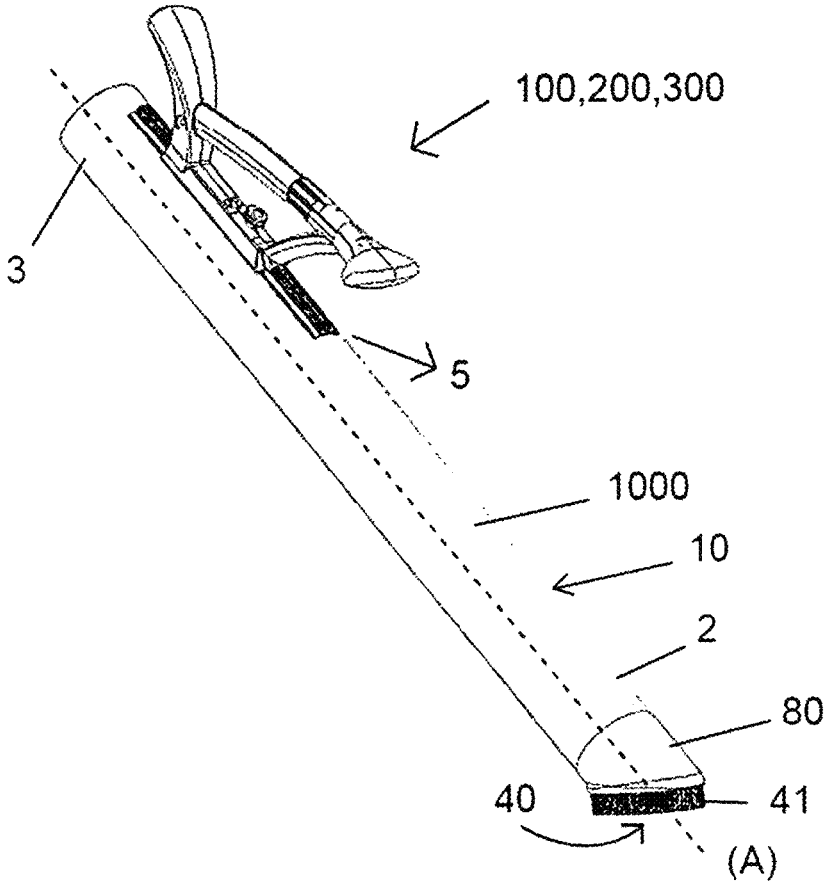
FIG. 2*a* shows a suction nozzle and gripping means as proposed according to the present invention.

In order to resolve these various drawbacks, a nozzle 10 has been proposed as shown diagrammatically in FIG. 2*a* and the following figures.

Figure 11:
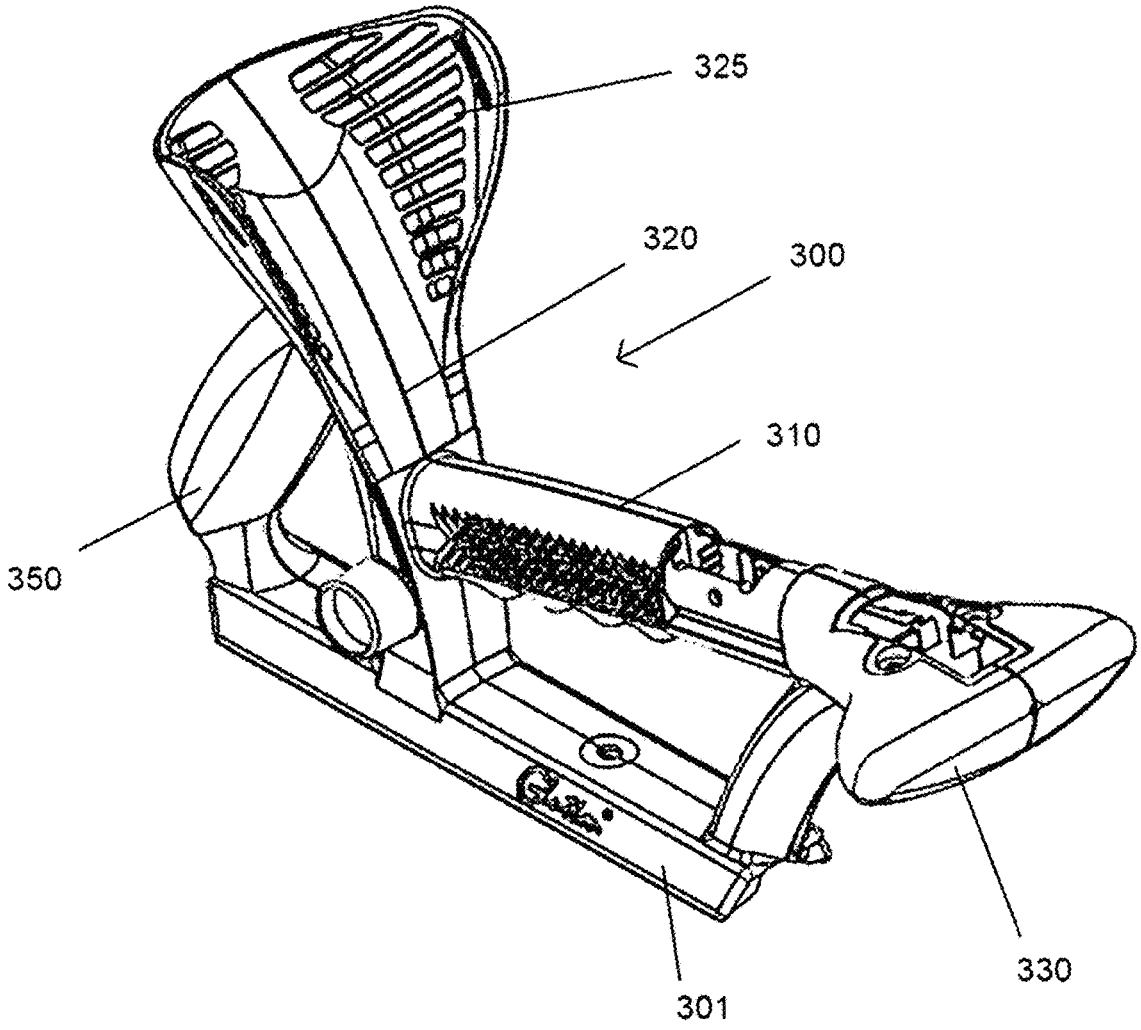
FIG. 11 shows a perspective view of the gripping means of said nozzle according to a third embodiment of the invention.
Figure 12:
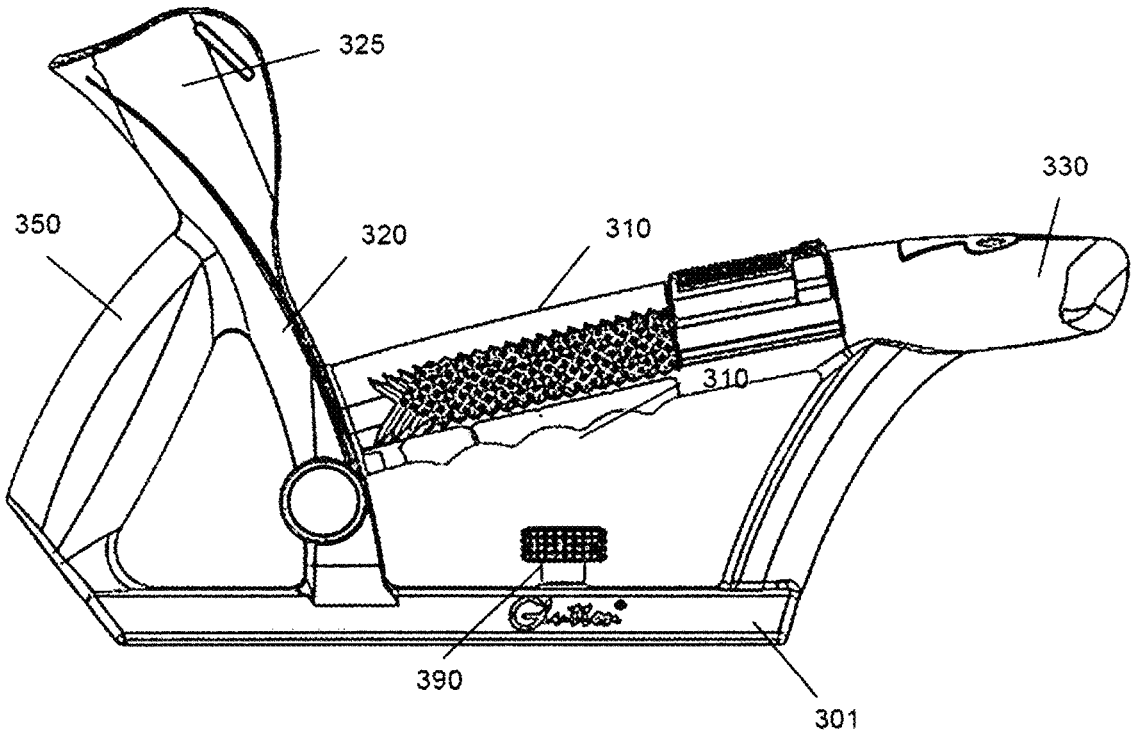
FIGS. 12 and 13 show profile or side views, from the distal end, of the gripping means according to a third embodiment as shown in FIG. 11.
Figure 13:
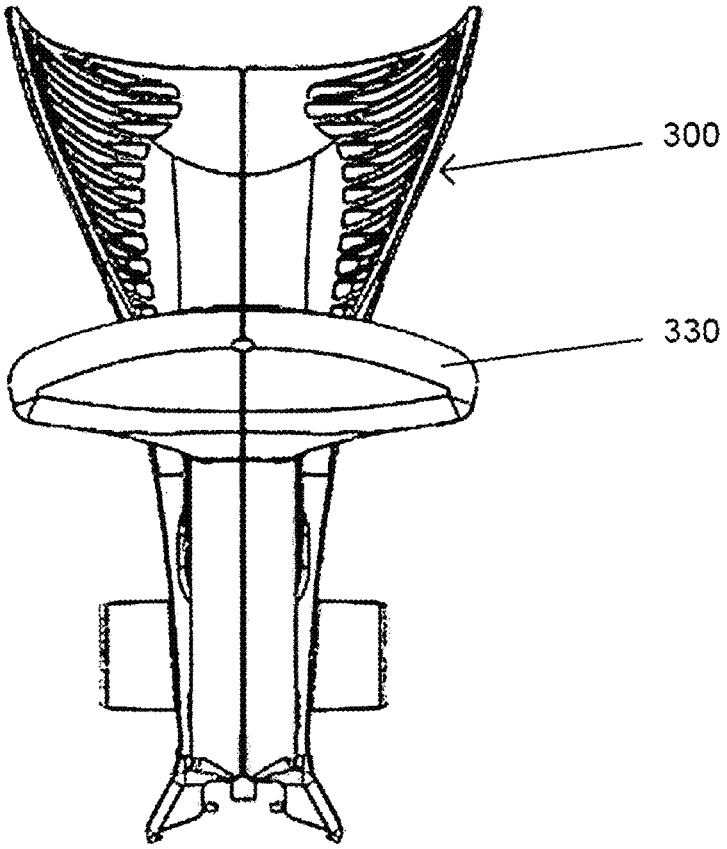

FIG. 2*a* shows the nozzle 10 according to the present invention. It is provided with ergonomic gripping means 100, 200, 300, 400 that will be described in more detail in FIGS. 3, 4, 5 and 6 according to a first embodiment, FIGS. 7, 8, 9 and 10; FIGS. 11, 12 and 13, and finally FIGS. 14, 15 and 16 respectively, according to the second, third and fourth embodiments.

The gripping means 100, 200, 300, 400 comprises at least:

- a first gripping element 110, 210, 310, 410 in the form of a handle, the length of which is preferably greater than 200 mm and the two distal and proximal ends of which are directly or indirectly connected to the base 101, 201, 301, 401 (there is no free end),
- a support element 120, 220, 320, 420 preferably having a height comprised between 200 and 350 mm,
- and a second gripping element 130, 230, 330, 430.

The gripping means 100, 200, 300, 400 preferably comprise an element that serves as a base 101, 201, 301, 401 on which the first gripping element will be positioned and is secured at each of its distal and proximal ends.

The height of the support element 120, 220, 320, 420 is sufficient to act as a lever, but must not serve as an armrest. In particular, this element does not prevent the positioning of the forearm freely when the hand grips the first gripping element.

The first gripping element 110, 210, 310, 410 is preferably placed longitudinally relative to the axis A of the nozzle 10.

According to a first alternative preferred embodiment, the first gripping element is positioned parallel to the central axis A or to one of the outer generatrices of the hose or tube 1000 of the nozzle 10.

According to another preferred alternative, the first gripping element 210, 310, 410 is positioned with an angle comprised between 5° and 45°, preferably between 10° and 35°, relative to the central axis A or one of the outer generatrices of the hose or tube 1000 of the nozzle 10. In another preferred embodiment (FIGS. 14 to 16), the first gripping element 410 is positioned with an angle comprised between 25° and 45° relative to the central axis A or one of the outer generatrices of the hose or tube 1000 of the nozzle 10.

Advantageously, the length of this first gripping element 110, 210, 310, 410 can be defined as a function of the morphology and size of the user, who is the sanitation agent.

Advantageously, the gripping elements 100, 200, 300, 400 can comprise, on the base 101, 201, 301, 401 a dovetail-shaped guideway that will be positioned on a rail 5, positioned longitudinally on the hose or tube 1000 of the nozzle 10, which will make it possible to still more precisely position the gripping means 100, 200, 300, 400 as a function of the user's morphology.

Figure 2B:
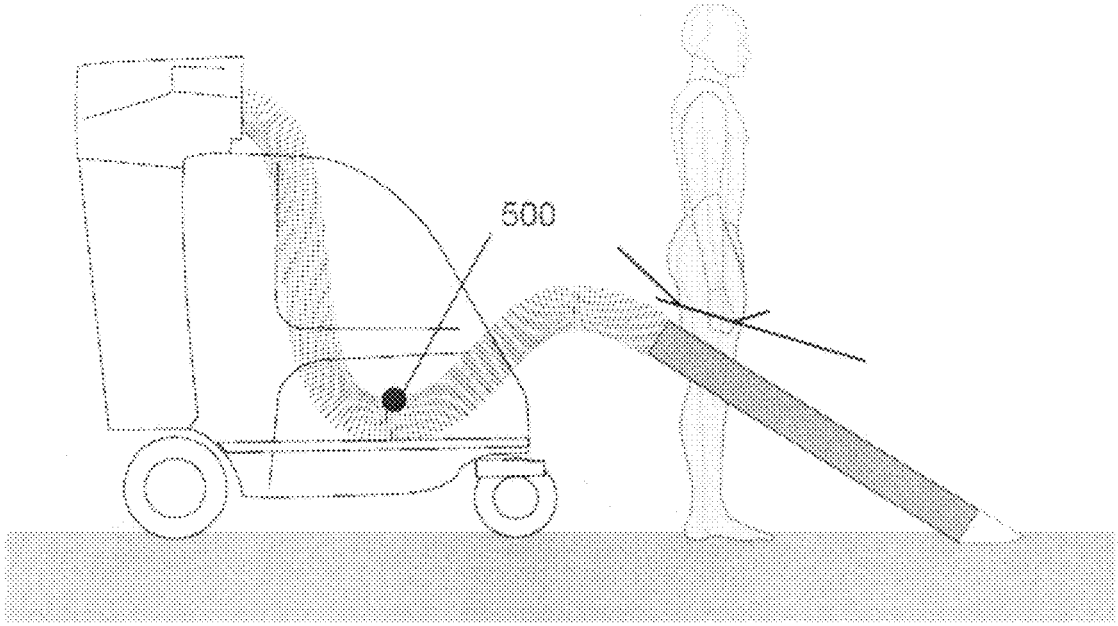
FIG. 2*b* shows the appropriate positioning of a user carrying or using a suction nozzle and its gripping means as proposed according to the present invention.
Figure 3:
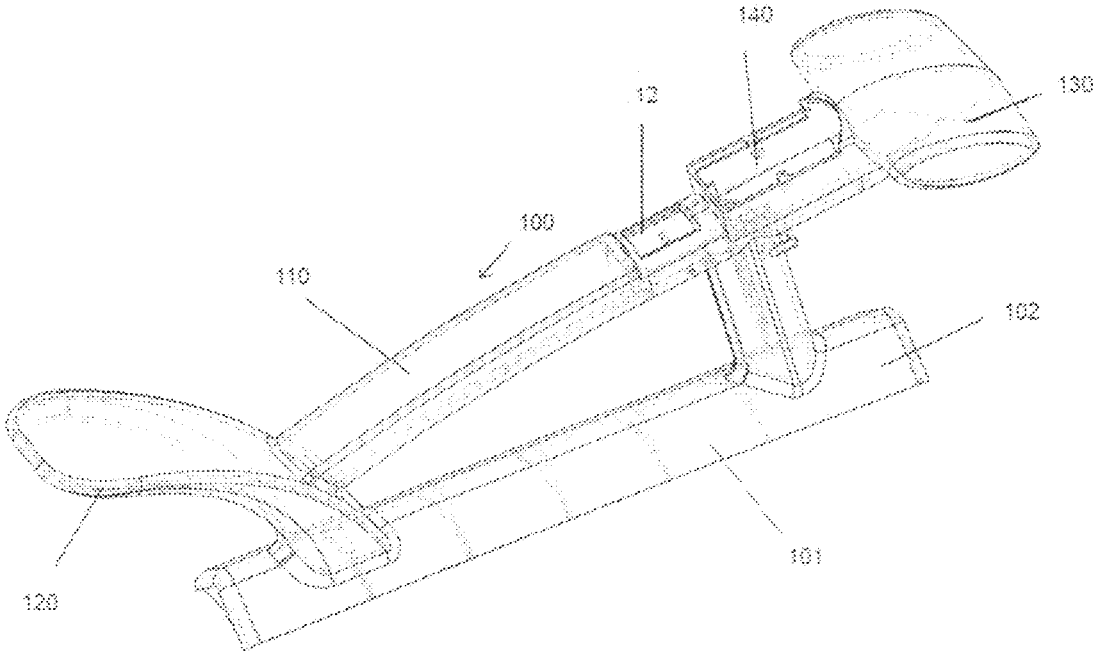
FIG. 3 shows a perspective view of the gripping means of said nozzle according to a first embodiment of the invention.
Figure 4:
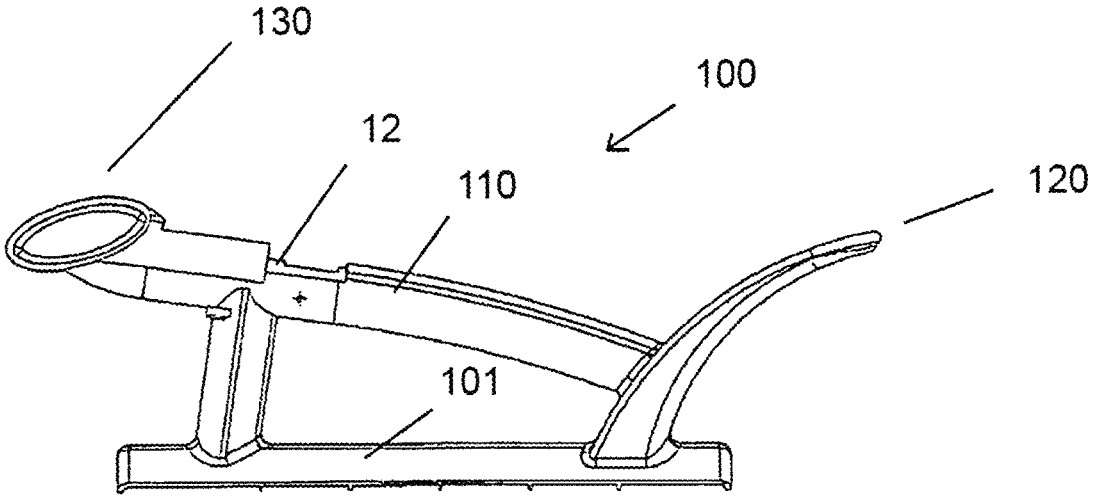
FIGS. 4, 5 and 6 show profile, top or side views, from the distal end, of the gripping means according to a first embodiment as shown in FIG. 3.
Figure 5:
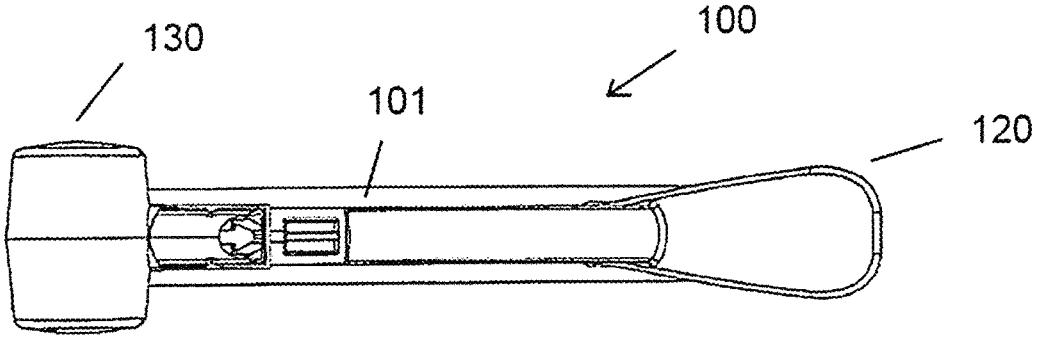
Figure 6:
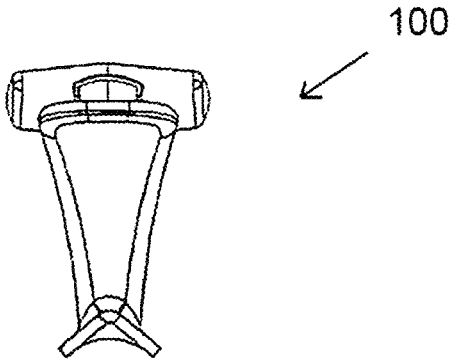
Figure 7:
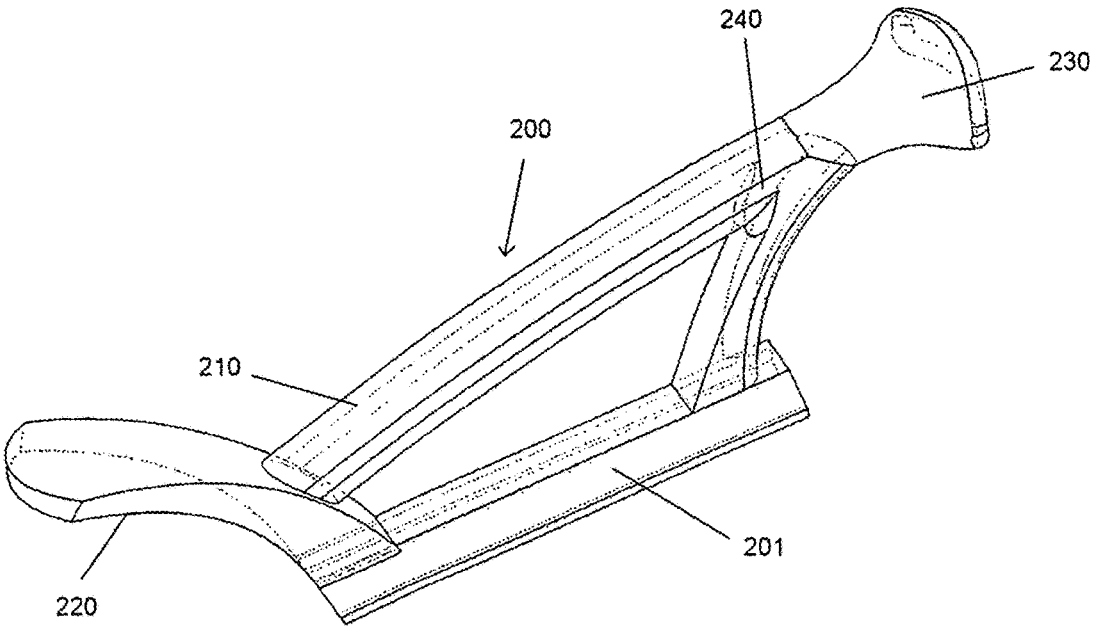
FIG. 7 shows a perspective view of the gripping means of said nozzle according to a second embodiment of the invention.
Figure 8:
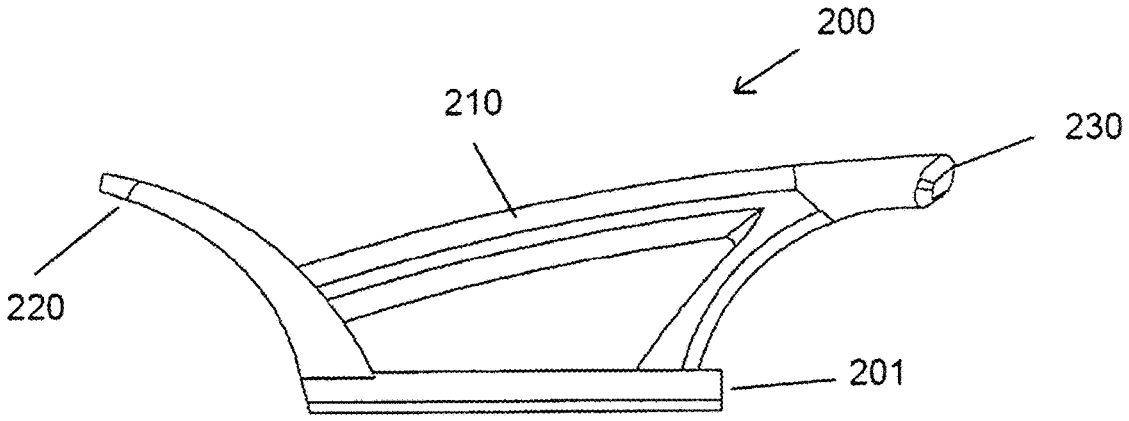
FIGS. 8, 9 and 10 show profile, top or side views, from the distal end, of the gripping means according to the second embodiment as shown in FIG. 7.
Figure 9:
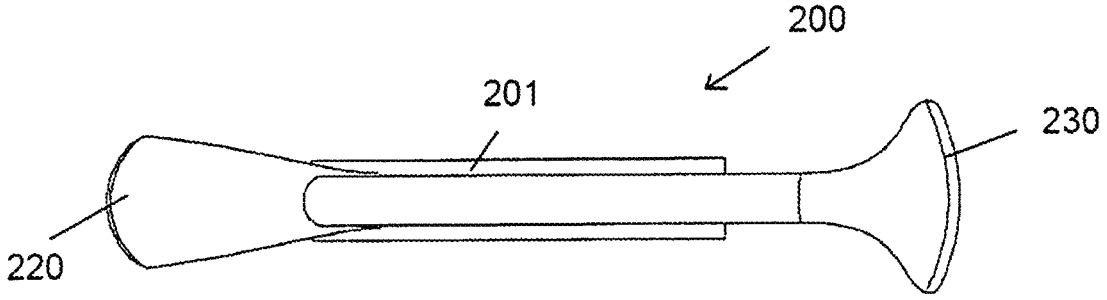
Figure 10:
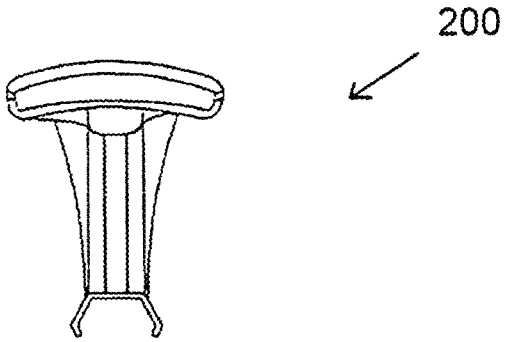

The length of the first gripping element 110, 210, 310, 410 and the positioning on the rail is preferably such that it makes it possible, under usage conditions, to place the user's hand, i.e., the sanitation agent, appropriately, such that when the arm is tensed and no pulling force is exerted, the nozzle 10 comes into contact with the ground (see FIG. 2*b*).

The first gripping element 110, 210, 310, 410 can be positioned on the rail using a knob (not shown) and will make it possible, based on the size and build of the user, for appropriate ergonomics to be acquired both during movements and during suction (see in particular FIG. 1*d*).

Appropriately, when waste has been suctioned and the suction nozzle 10 needs to be moved toward a new suction zone, it is necessary to lift it in order to break the contact between the floor or the wall to be suctioned and said nozzle. The force to be exerted on said nozzle 10 can reach several tens of Newtons, in general more than 30 Newtons (30 N).

To that end, it is provided to have a support element 120, 220, 320, 420 acting as a lever and that is positioned at one end of the first gripping element 110, 210, 310 and toward the proximal end 3 of the suction nozzle 10. This support element 120, 220, 320, 420 appropriately has a height of at least 180 mm but less than 350 mm from its base and is formatted ergonomically, so as to avoid any injury with the user's forearm or elbow.

Advantageously, this support element 120, 220, 320 is positioned with an angle comprised between 95° and 145° relative to the first gripping element 110, 210, 310, 410. In this way, under usage conditions, part of the user's forearm will come into contact with the support so as to be able to exert a lever force when necessary. Despite the fact that the end of the nozzle will tend to adhere directly to the ground, this arrangement allows the user to lift said nozzle using a single arm.

As shown in detail in FIGS. 11 to 13, the support element also has fins 325 in order to avoid any lateral slipping of the forearm.

It should be noted that advantageously, the support element, which has an angle greater than 90°, preferably greater than 95° relative to the first gripping element, has an outwardly curved shape (convex shape) of its distal part and as a result, in its distal part, has an angle often greater than 130°. This arrangement advantageously makes it possible for the forearm to be positioned freely when the suction nozzle touches the ground and only to serve as a support element during separation thereof from the ground (during lifting of the nozzle).

Still more advantageously, in order to reinforce this movement and not exert excessive force in a single arm or shoulder, a second gripping element 130, 230, 330, 430 in the form of an additional handle can be provided at the gripping means, at the other end of the first gripping element 110, 210, 310, 410 toward the distal side 2 of the suction nozzle 10. This gripping handle 130, 230, 330, 430 will advantageously be used by the user with the second hand, which will make it possible to exert a combined force with both arms and therefore both shoulders on said suction nozzle 10 to lift it and break the contact between it and the ground or walls to be suctioned.

Preferably, the presence of a second gripping element 130, 230, 330, 430 makes it possible, under usage conditions, to have two-handed gripping by the user, which is particularly effective in case of rubbing or brushing of the surface to be cleaned. The force exerted will be greater and the cleaning effectiveness will be increased.

Figure 14:
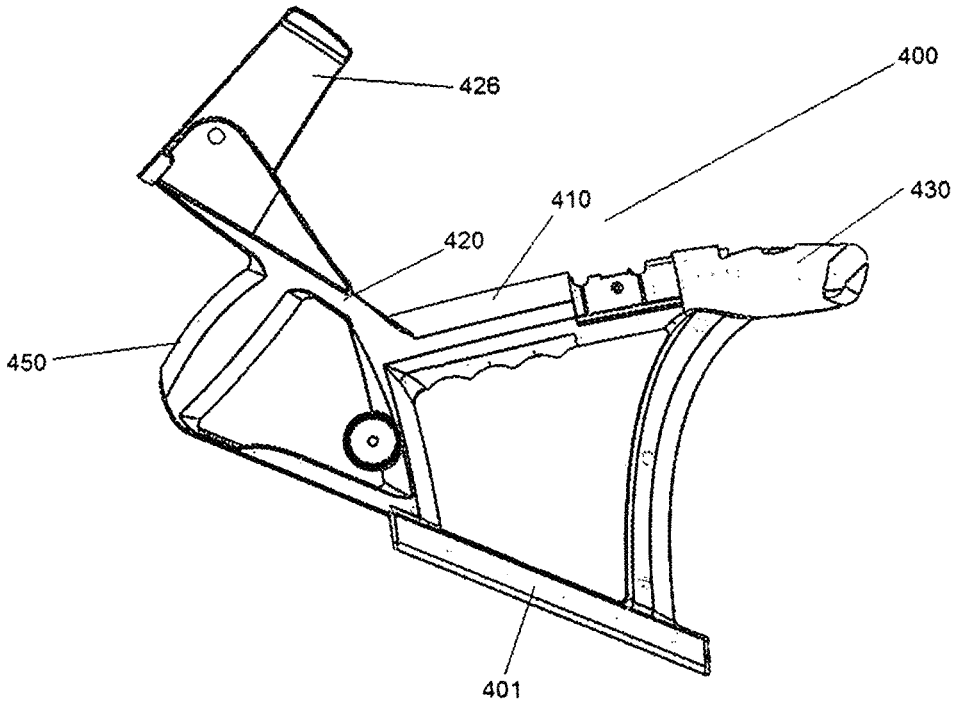
FIGS. 14, 15 and 16 represent another preferred embodiment of the present invention in a side or perspective view.
Figure 15:
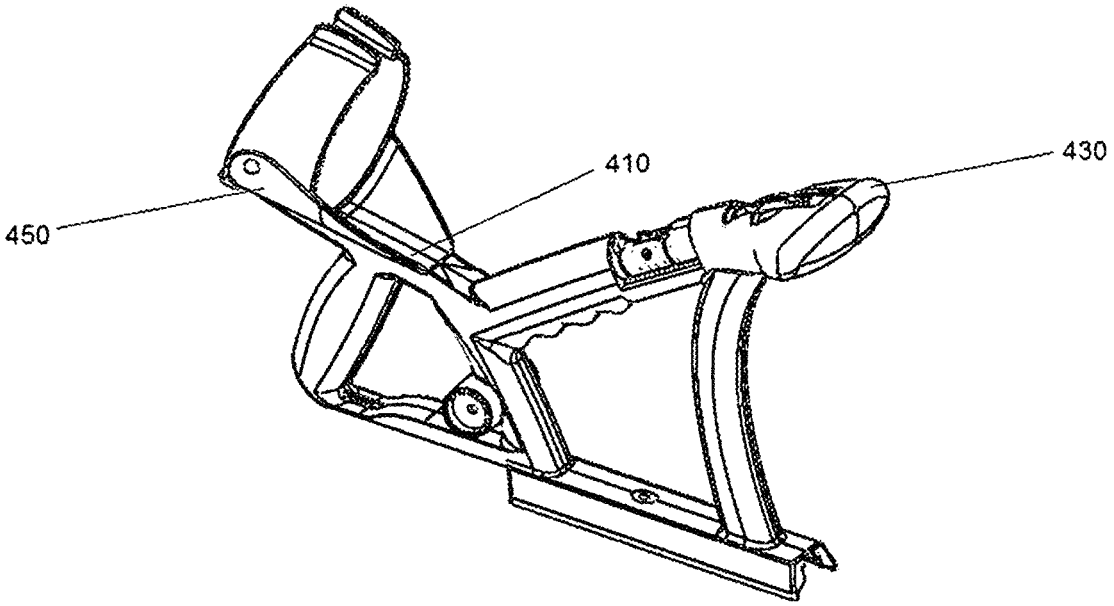
Figure 16:
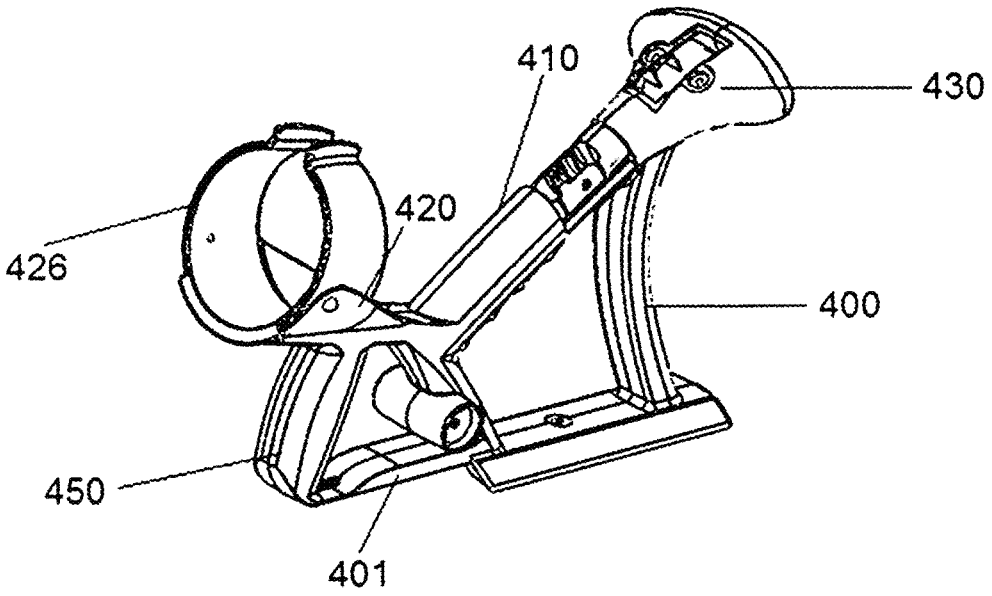

FIGS. 14 to 16 represent another preferred embodiment wherein the angles between the first gripping element and the central axis of the hose of the nozzle is preferably comprised between 25° and 45°, while the angle over the distal part of the support element with the first gripping element is greater than 120°

The present invention thus proposes a solution which, advantageously, allows a more natural arrangement of the hand when idle, in particular, without there being any offset of the application axis of the loads, both during movement and during suction (see FIG. 2*b*).

Particularly advantageously, it is also possible to consider the presence of a control switch 12 of the turbine, placed directly on the gripping means, and in particular on the first gripping element 110, 210, 310 in handle form.

Still more advantageously, this control assumes a rotating form in order to make it possible to lighten the force to be exerted with the user's forearm, the user thus being able to go easily from the gripping position of the handle to an action position of the control (on/off-booster).

In the embodiment represented in FIGS. 14 to 16 it is even provided with selection control switch in order to make a selection according to the nature of the material which can be directed to a specific basket or container.

According to another preferred embodiment, it is also possible to provide, on the suction nozzle 10, not a compact, rigid or semi-rigid shoe 80, but sweeping elements assuming the form of brush bristles or sweeping fringes 41 optionally secured to a shoe 80. The sweeping elements serve two purposes. The first, obvious purpose is that it will be possible to use the sweeping elements to sand or clean the surfaces to be suctioned (for example, dust). The second, more surprising purpose of the presence of the sweeping elements is that they make it possible for the contact between the distal end 2 of the suction nozzle 10 on the ground or walls to be suctioned no longer to be complete or total. In this way, a certain quantity of air is still allowed to pass through the orifices 40 between the sweeping elements 41, which will necessarily generate a lower suction force (little pressure) and will thereby make it possible to lift said suction nozzle more easily.

Lastly, and advantageously, using relatively rigid bristles will also make it possible to keep or reinforce the damping function of the distal end of the nozzle.

According to still another preferred embodiment, it is possible to consider combining a fastening point 500 of the flexible hose 20 on the lower half of the self-propelled device 1 with the various elements described above. This will have the advantage of decreasing the total load related to the weight of the flexible hose 20 directly on the arm of the sanitation agent (see FIG. 2*b*).

It is also possible to consider the presence of a caster at the end of the shoe, which allows easier movement of that accessory (not shown).

Figure 17:
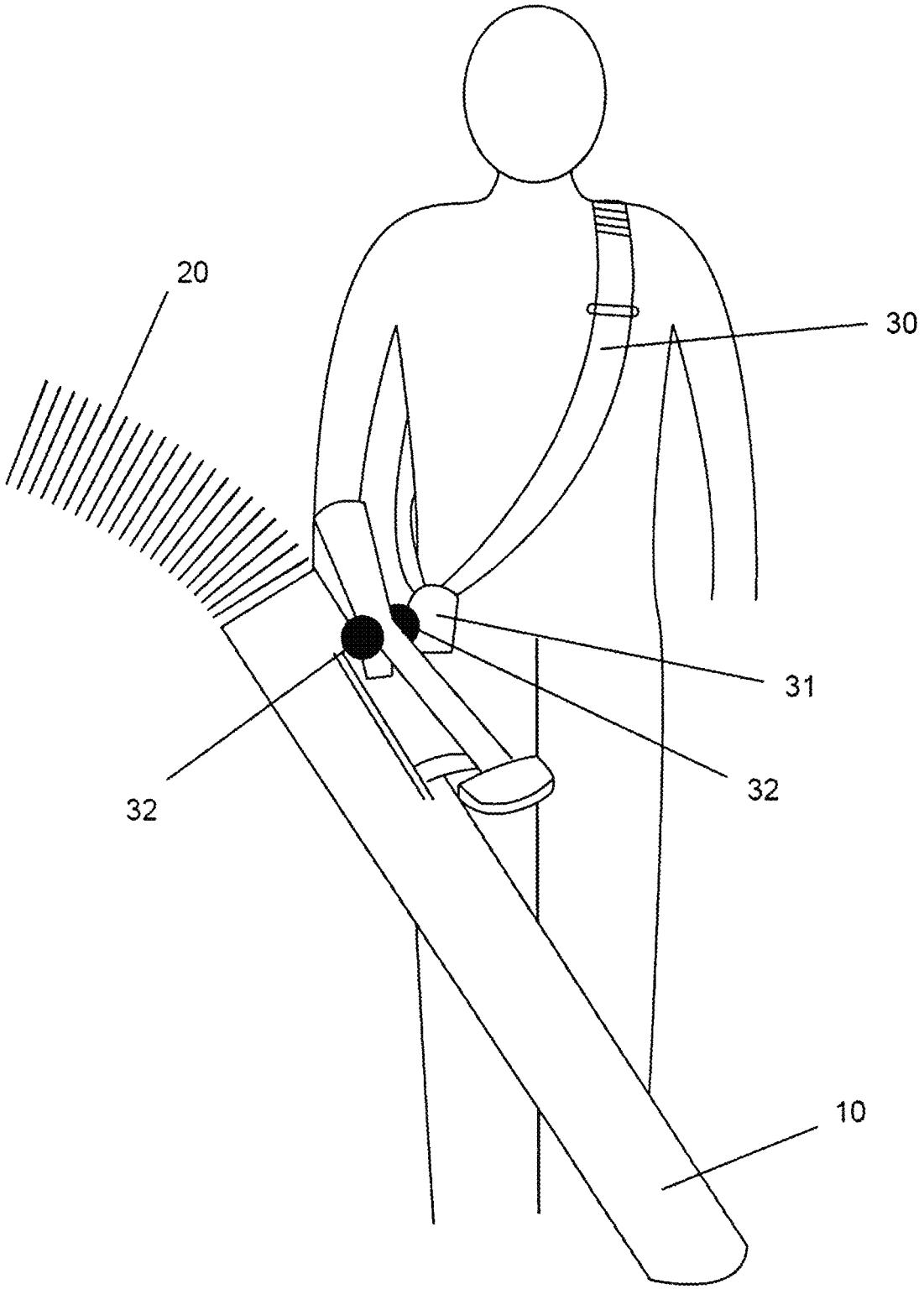
FIGS. 17 and 18 correspond to one example embodiment of a second object of the invention in which the suction nozzle (or any portable device or object) is maintained/supported by maintaining or support means such as a strap, a shoulder strap and comprising coupling/uncoupling means that are easy to use.
Figure 18:
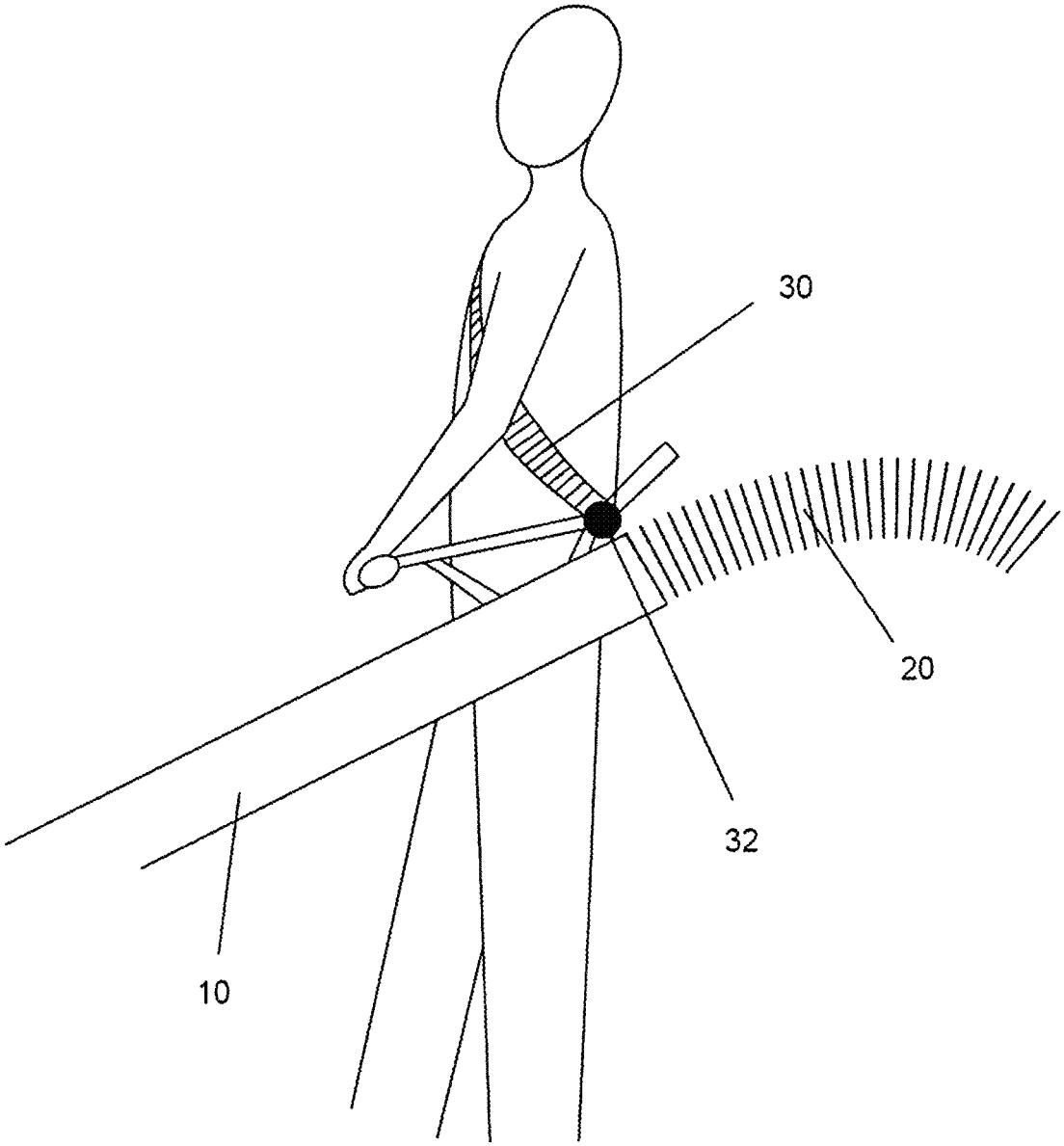

According to another aspect of the invention, it is also possible to consider the presence and use of a harness or an additional strap 30 that makes it possible to bear the weight of said nozzle and part of the weight of the flexible hose (see FIGS. 17 and 18).

Advantageously, the combination of the different elements of the present invention makes it possible to offer the user gripping means that offer great movement freedom due to the fact that they eliminate the presence of an armrest and thereby allow the user to extend his arm to look for waste relatively far away around the urban or industrial aspirator.

According to a second object, the present invention also aims to protect the maintaining or support means for a portable device or object such as a suction nozzle 10.

In order to still further improve the ergonomics of the device, it is considered to propose assistance or support for the maintenance of a portable device or object such as a suction nozzle. Indeed, this assistance or support will be particularly useful in the case of very long use that may reach several hours.

This assistance or support constituting the maintaining or support means may assume the form of a harness, but may also, and particularly advantageously, assume the form of a strap or shoulder strap 30, as illustrated in FIGS. 17 and 18 in the particular case of the suction nozzle according to the invention.

Means that allow the quick and easy attachment and separation (coupling and uncoupling) of said strap, shoulder strap or harness are also provided. They can assume the form of a hook, pushbutton, or particularly advantageously, a magnet 32 and its counter-magnet 31.

According to one preferred embodiment, the second object of the invention relates to maintaining or support means 30 for a portable device or object 10 that allow quick and easy fastening with particularly appropriate positioning of the device or object to be carried.

Preferably, a magnet 32 is positioned on the device or object to be carried, while a metal piece 31 serving as a counter-magnet is positioned on the maintaining or support means 30. The reverse may also be proposed, i.e., a metal piece is positioned on the device or object to be carried and a magnet is positioned on the maintaining or support means. By using a magnet, one avoids the drawbacks related to the presence of a hook, which could catch on outside elements such as clothing. The presence of the magnet on the maintaining or support means offers the advantage of not interfering with the control present on the nozzle.

Using a magnet coupling/uncoupling system also makes it possible to position it with very considerable freedom. Lastly, visual contact is not necessary for coupling to occur.

Particularly advantageously and as illustrated in FIG. 17 as an example, it is proposed to place a stationary magnet 32 symmetrically on either side on the device or object to be carried 10, in particular on the left part, but also on the right part of the device or object to be carried, such as a suction nozzle, while a simple metal plate 31 is positioned on the maintaining or support means formed by the strap, shoulder strap or harness 30. Of course, the reverse configuration may also be proposed, i.e., the presence of two plates positioned on either side on the device or object to be carried with a single magnet on the maintaining or support means.

There may be multiple advantages to this: it is no longer necessary to look for a hook, the attraction force itself between the magnet and the metal plate will directly and appropriately position the device or object to be carried 10 relative to its maintaining or support means 30.

In case of accident or breakdown, the user is immediately able to free himself and evacuate the area; the uncoupling will be done simply by applying a small shear force on the securing means 30, for example simply by pushing the device or object to be carried 10 downward, preferably using a handle, for example like the handle 110, 210, 310, 410 according to the invention. Thus, the device or object to be carried 10 will slide on the metal plate 31 and detach from it.

The invention is particularly useful when a suction nozzle needs to be carried, for example like that according to the invention. One example embodiment is in particular described in FIGS. 12 and 13 or in FIGS. 14 to 16. The means used above can easily be used here and will greatly facilitate the sanitation agent's task. This will especially be the case in a humid atmosphere. Indeed, under these usage conditions, the flexible hose 20 can become several kilos heavier, which the user will have to carry in addition to the suction nozzle 10. Likewise, after long handling (at the end of the day) or when the user moves, it is proposed to have a strap 30 that supports (carrying assistance) the suction nozzle 10. However, in order to meet safety requirements, as well as to facilitate the use of a suction nozzle 10, the strap or harness 30 should easily be able to attach to and detach from the object to be carried 10.

Particularly advantageously, the securing means are made using a magnet 32 and a counter-magnet (metal plate) 31. Of course, such a coupling/uncoupling system can apply to any cumbersome object that needs to be transported or carried using a strap, shoulder strap or harness.

Advantageously, the nozzle can assume the form of a telescoping nozzle whereof the distal part could deploy (by elongation).

Furthermore, it is also possible to design a nozzle whose distal part would also be provided with a certain number of accessories intended for specific uses, such as picking up leaves around trees, brushing, etc.

The combined assembly of all or some of these elements will allow better, more relaxed ergonomics for the sanitation agent. One will thus see that fatigue and discomfort will decrease, even for relatively long usage periods of up to several hours, or even a full day.

The invention claimed is:

1. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and a second gripping element and optionally a base, and wherein the second gripping element is positioned at the end of the first gripping element toward the distal end of said nozzle, while the support element serving as a lever is positioned toward the proximal end of said nozzle.

2. The device according to claim 1, wherein the length of the first gripping element is greater than 200 mm.

3. The device according to claim 1, wherein the height of the first gripping element is less than 100 mm.

4. The device according to claim 1, wherein the first gripping element has both its distal and proximal ends directly or indirectly connected to the rigid hose or tube of the nozzle.

5. The device according to claim 1, wherein the gripping means are secured to a sliding rail on which they can move.

6. The device according to claim 1, wherein the first gripping element in the form of a handle is positioned longitudinally on the hose of the suction nozzle.

7. The device according to claim 6, wherein the first gripping element in the form of a handle is positioned parallel to one of the generatrices of the hose of the nozzle.

8. The device according to claim 6, wherein the first gripping element in the form of a handle is positioned with an angle comprised between 5° and 60° relative to the central axis or one of the generatrices of the hose of the nozzle.

9. The device according to claim 1, wherein the support element is positioned with an angle comprised between 95° and 145° relative to the first gripping element in handle form.

10. The device according to claim 1, wherein the support element has an outwardly curved shape.

11. The device according to claim 10, wherein the support element has an angle over its distal part with a first gripping element greater than 120°.

12. The device according to claim 1, wherein the support element has, from the base, a height of at least 200 mm.

13. The device according to claim 1, wherein the gripping means are equipped with a control switch, for a suction turbine comprised in the urban or industrial aspirator and optionally selection switch allowing the choice of the nature of the material to be treated.

14. The device according to claim 13, wherein the command of the suction turbine is done wirelessly or by radio frequency (RF).

15. The device according to claim 1, wherein the gripping means are symmetrical so as to allow ambidextrous use.

16. The device according to claim 1, wherein the gripping means further comprise a third gripping element used to reinforce the structure, and which connects the support element to the nozzle.

17. The device according to claim 1, wherein the nozzle is equipped with a shoe made from a rigid or nonrigid material whereof the distal end has a design allowing an air intake through orifices.

18. The device according to claim 17, comprising means allowing the introduction of air through the orifices, wherein said means are made up of or comprise sweeping elements such as fringe or bristles.

19. The device according to claim 1, wherein it is provided with maintaining or support means in the form of a strap, shoulder strap or harness, that comprises coupling/uncoupling means in the form of a magnet/counter-magnet assembly or a magnet/metal plate assembly, that allows fast and easy coupling/uncoupling.

20. The device according to claim 19, wherein the magnet/counter-magnet assembly or the magnet/metal plate assembly is placed on either side of the device so as to make its manipulation ambidextrous.

21. An apparatus, called urban or industrial aspirator, that is self-propelled or optionally on which a user is seated, comprising a device as described according to claim 1.

22. The apparatus according to claim 21, comprising a fastening point for a flexible hose coupled between the proximal end of the rigid hose or tube and the apparatus, wherein the fastening point is positioned at the lower half of said device.

23. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and optionally a second gripping element and/or optionally a base, wherein the first gripping element in the form of a handle is positioned parallel to one of the generatrices of the hose of the nozzle.

24. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and optionally a second gripping element and/or optionally a base, wherein the gripping means are equipped with a control switch, for a suction turbine comprised in the urban or industrial aspirator, and optionally selection switch allowing the choice of the nature of the material to be treated.

25. The device according to claim 24, wherein the command of the suction turbine is done wirelessly or by radio frequency (RF).

26. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and optionally a second gripping element and/or optionally a base, wherein the gripping means are symmetrical so as to allow ambidextrous use.

27. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and optionally a second gripping element and/or optionally a base, wherein the nozzle is equipped with a shoe made from a rigid or non-rigid material whereof the distal end has a design allowing an air intake through orifices and comprising means allowing the introduction of air through the orifices, wherein said means are made up of or comprise sweeping elements such as fringe or bristles.

28. A device in the form of a suction nozzle for an urban or industrial aspirator, comprising a rigid hose or tube having a central axis and a plurality of generatrices, said rigid hose or tube comprising gripping means that comprise a first gripping element in the form of a handle, a support element serving as a lever, and optionally a second gripping element and/or optionally a base, wherein it is provided with maintaining or support means in the form of a strap, shoulder strap or harness, that comprises coupling/uncoupling means in the form of a magnet/counter-magnet assembly or a magnet/metal plate assembly, that allows fast and easy coupling/uncoupling.

29. The device according to claim 28, wherein the magnet/counter-magnet assembly or the magnet/metal plate assembly is placed on either side of the device so as to make its manipulation ambidextrous.

30. The device according to claim 1, wherein the first gripping element has both its distal and proximal ends directly or indirectly connected to the rigid hose or tube of the nozzle by the base.

31. The device according to claim 1, wherein the gripping means are secured to a sliding rail on which they can move, said rail being positioned longitudinally and parallel to the central axis on the outer periphery of the rigid hose or tube of the suction nozzle.

32. The device according to claim 6, wherein the first gripping element in the form of a handle is positioned with an angle comprised 25° and 45° relative to the central axis or one of the generatrices of the hose of the nozzle.

33. The device according to claim 1, wherein the support element has, from the base, a height of at least 250 mm.

34. The device according to claim 1, wherein the gripping means are equipped with a rotating control switch, for a suction turbine comprised in the urban or industrial aspirator and optionally selection switch allowing the choice of the nature of the material to be treated.

35. The device according to claim 1, wherein the gripping means further comprise a third gripping element used to reinforce the structure, and which connects the support element to the nozzle and to the base of the gripping means.

36. The device according to claim 1, wherein the support element has an outwardly curved shape over its distal part.

* * * * *